United States Patent [19]

van der Voort et al.

[11] Patent Number: 4,526,849

[45] Date of Patent: Jul. 2, 1985

[54] MULTILAYER ELECTROPHOTOGRAPHIC AMORPHOUS SILICON ELEMENT FOR ELECTROPHOTOGRAPHIC COPYING PROCESSES

[75] Inventors: Gabriël N. M. M. van der Voort, Delft; Marinus Groeneveld, Eindhoven, both of Netherlands

[73] Assignee: Océ-Nederland B.V., Venlo, Netherlands

[21] Appl. No.: 542,641

[22] Filed: Oct. 17, 1983

[30] Foreign Application Priority Data

Oct. 21, 1982 [NL] Netherlands ..... 8204056

[51] Int. Cl.[3] ..... G03G 5/082

[52] U.S. Cl. ..... 430/57; 430/60; 430/65; 430/95; 252/501.1; 427/74; 357/2

[58] Field of Search ..... 430/57, 60, 65; 252/501.1; 357/2; 427/74

[56] References Cited

U.S. PATENT DOCUMENTS

| | | | |
|---|---|---|---|
| 4,226,898 | 10/1980 | Ovshinsky et al. | 430/84 X |
| 4,271,328 | 6/1981 | Hamakawa et al. | 357/2 X |
| 4,330,182 | 5/1982 | Coleman | 430/57 X |
| 4,342,044 | 7/1982 | Ovshinsky et al. | 430/57 X |
| 4,378,417 | 3/1983 | Maruyama et al. | 430/57 |
| 4,379,943 | 4/1983 | Yang et al. | 427/74 X |
| 4,443,529 | 4/1984 | Kanabe et al. | 430/65 |
| 4,452,874 | 6/1984 | Ogawa et al. | 430/57 |
| 4,452,875 | 6/1984 | Ogawa et al. | 430/57 |
| 4,453,173 | 6/1984 | Carlson et al. | 357/2 X |

FOREIGN PATENT DOCUMENTS

| | | |
|---|---|---|
| 2018446 | 10/1979 | United Kingdom . |
| 2077451 | 12/1981 | United Kingdom . |

OTHER PUBLICATIONS

Minolta Camera, Patent Abstracts of Japan, vol. 5, No. 48, p. 55, (Apr. 7, 1981)-re Japanese Publication 56-4151 (A) Jan. 17, 1981.

Canon K. K., Patent Abstracts of Japan, vol. 6, No. 62, p. 111, (Apr. 21, 1982)-re Japanese Publication 57-4053 (A), Jan. 9, 1982.

*Primary Examiner*—Roland E. Martin

*Attorney, Agent, or Firm*—Albert C. Johnston; William J. Speranza

[57] ABSTRACT

An amorphous silicon based photoconductive element for use in electrophotographic copying processes, which exhibits a suitably low dark discharge rate with other good photoelectric properties, is composed of an electrically conductive support having applied thereto, in sequence, a barrier layer consisting essentially of a doped hydrogen-containing amorphous silicon, an intermediate layer consisting essentially of substantially undoped hydrogen-containing amorphous silicon, an intermediate barrier layer consisting essentially of doped hydrogen-containing amorphous silicon and a main, charge receiving layer consisting essentially of substantially undoped hydrogen-containing amorphous silicon.

8 Claims, 1 Drawing Figure

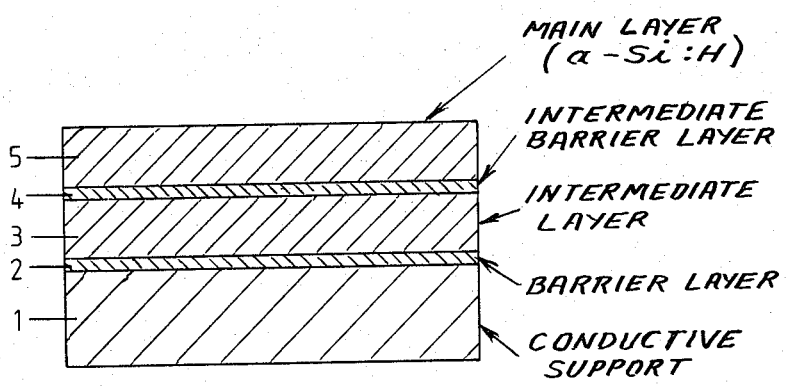
MAIN LAYER
(a-Si:H)
INTERMEDIATE
BARRIER LAYER
INTERMEDIATE
LAYER
BARRIER LAYER
CONDUCTIVE
SUPPORT
5
4
3
2
1

MULTILAYER ELECTROPHOTOGRAPHIC AMORPHOUS SILICON ELEMENT FOR ELECTROPHOTOGRAPHIC COPYING PROCESSES

This invention relates to a photoconductive element for use in electrophotographic copying processes, of a kind in which an electrically conductive support has applied to it a barrier layer consisting of a doped hydrogen-containing amorphous silicon and carries on the barrier layer a main layer consisting of hydrogen-containing amorphous silicon that is entirely or practically undoped.

In a photoconductive element of that kind, as described in Philosophical Magazine, Vol. B 43 (1981, No. 6), pages 1079–1089, a barrier layer applied to a conductive support consists of hydrogen-containing amorphous silicon doped with phosphorus or boron, e.g. 350 ppm boron, and has a thickness of 0.2 μm; and a main layer applied to the barrier layer consists of hydrogen-containing amorphous silicon that is practically undoped and has a thickness of 10 μm.

A photoconductive element so constituted exhibits a variety of good photoelectric properties, such as a high acceptance potential and high photosensitivity and a low residual potential after exposure. But, like the other hitherto proposed photoconductive elements based on silicon, such an element has the disadvantage that the specific resistance of the silicon layers is too low and, consequently, the dark discharge property of the element is too high for electrophotographic use.

Attempts have been made for a long time to increase the specific resistance of silicon so as to make the substance useful in electrophotography. The attempts have included variations of the method of preparation, extensive purification, and accurate doping of the silicon. So far as known, however, the specific resistance has not been made higher than $10^{13}$ Ohm. cm, and a specific resistance of this order is too low for use of the silicon in photoconductive elements of the construction usually employed for use in electrophotographic copying processes.

The object of the present invention is to provide photoconductive elements based on amorphous silicon in which the dark discharge properties are improved without affecting the other, desirable electrophotographic properties of such elements.

To this end, according to the invention, a photoconductive element is provided which comprises an electrically conductive support having applied thereto a barrier layer consisting essentially of a doped hydrogen-containing amorphous silicon, next to said barrier layer an intermediate layer consisting essentially of entirely or practically undoped hydrogen-containing amorphous silicon, next to said intermediate layer an intermediate barrier layer consisting essentially of doped hydrogen-containing amorphous silicon, and on a said intermediate barrier layer a main layer consisting essentially of entirely or practically undoped hydrogen-containing amorphous silicon.

It has been found surprisingly that the dark discharge properties of an amorphous silicon based photoconductive element are significantly enhanced when its photoconductive layer structure is made to contain between the barrier layer and the main, charge-receiving layer an intermediate layer overlaid by an intermediate barrier layer as herein described.

The dark discharge properties can be very greatly improved by a single such intermediate layer in the photoconductive layer structure, particularly when this layer is made with a thickness of at least 3 μm. The enhancing effect can also be realized, though to a lesser extent, when the layer structure is made with plural intermediate layers of the undoped silicon with each of these overlaid by an intermediate barrier layer of the doped silicon.

Thus, for instance, favorable dark discharge properties are obtained with an element according to the invention made with three intermediate layers, each of about 1.3 μm in thickness, alternating with three intermediate barrier layers each of about 0.1 to 0.3 μm in thickness; but the dark discharge properties are considerably even more favorable in the case of an element made with a single intermediate layer of about 3.8 μm in thickness overlaid by a single intermediate barrier layer.

Since the charging properties of a photoconductive element are more favorable in the case of positive charging than with negative charging, it is advantageous to make a photoconductive element according to the invention with the barrier and intermediate barrier layers each consisting essentially of boron-doped p-type conductive amorphous silicon and with the intermediate and main layers each consisting essentially of intrinsic (undoped) amorphous silicon which by nature has a slight preference for n-type conductivity. In this case, even a slight doping of the intermediate layer to make it more highly n-type conductive is unfavorable.

If the photoconductive element is to be suitable for negative charging, the barrier and intermediate barrier layers should be n-type conductive, as caused e.g. by doping with phosphorus, and the intermediate and main layers may if required be very slightly doped with boron in order to make them preferentially p-type conductive to some extent. Such a very slightly doped silicon, which may be doped with quantities of boron up to about 30 ppm, is to be regarded as practically undoped.

The undoped hydrogen-containing silicon layers are preferably layers obtained by precipitating silicon from silane gas under the influence of a glow-discharge plasma onto a support which, together with any layers already present, is being held at a temperature of 150° to 200° C. The glow-discharge plasma can be generated, for example, by placing the silane under reduced pressure in an electromagnetic field having a frequency of 4–13 MHz. The doped layers can be obtained in the same way by precipitating them from silane which contains a small quantity of diborane in the case of doping with boron, or contains a small quantity of phosphine if phosphorus is used for doping.

The support of the photoconductive element may be composed of any electrically conductive material, but in view of the electrophotographic use the support preferably is made in the form of a drum having a cylindrical peripheral surface of aluminum or stainless steel.

The barrier layers of the element can be very thin. A thickness of 0.1 to 0.3 μm generally is ample for each of them, but thickner or thinner layers also can be employed. In order to obtain the required charging level the thickness of the main layer, which may vary within wide limits, preferably is not less than 1 μm. Main layers having a thickness of about 2 to 10 μm generally give very good results, but thickness outside this range may also be effective.

The accompanying drawing schematically illustrates at a greatly enlarged scale a portion of a photoconductive element having an amorphous silicon based layer structure according to the present invention. Legends on the drawing indicate the nature of the respective layers 2, 3, 4 and 5 overlying one another on the electrically conductive support 1.

The principles of the invention and ways of practising it will be further evident from the following illustrative examples.

EXAMPLE I

An a.c. voltage at a frequency of 13 MHz was applied between a stainless steel plate in a reactor and an electrode outside the reactor, and the plate was heated to 175° C. Silane gas containing 1% by weight of diborane was passed at a pressure of 1 mbar and a speed of 40 $cm^3$ per minute between the plate and the electrode. The supply of diborane was stoppd after a p-type conductive boron-doped amorphous silicon barrier layer having a thickness of about 0.2 μm was formed on the stainless steel plate.

The process was then continued without diborane under the same conditions until an intrinsic (undoped) amorphous silicon intermediate layer having a thickness of about 3.8 μm was formed on the barrier layer. Then another boron containing barrier layer having a thickness of about 0.2 μm, formed in exactly the same way as before, was applied to the intermediate layer. And then a main layer substantially free of boron and having a thickness of about 3.8 μm was applied to the second, or intermediate, barrier layer.

Upon maximum charging of the resulting photoconductive element in the dark the element still retained 75% of its charge after 5 seconds, and it took 100 seconds to discharge to 40%.

EXAMPLE II

A photoconductive element was made in the same way and with the same composition as described in Example I, except for the intermediate layer which was 1.3 μm thick instead of 3.8 μm thick. This photoconductive element was found to discharge to 65% in 5 seconds and to discharge (in the dark) to 40% in 20 seconds.

EXAMPLE III

A photoconductive element was made with an amorphous silicon layer structure formed of three intermediate layers each having a thickness of 1.3 μm, a main layer having a thickness of 3.8 μm and four barrier layers, each of 0.2 μm thickness, to separate the main layer, the intermediate layers and the support from one another. This element discharged in the dark to 71% in 5 seconds and to 40% in 50 seconds. The barrier layers, intermediate layers and main layer had the same composition as those in Example I.

A comparable photoconductive element made according to the prior art, having one barrier layer and one main layer of approximately 8 μm in thickness required only 10 seconds for a 40% discharge in the dark.

What is claimed is:

1. An electrophotographic element for use in electrophotographic copying processes, comprising an electrically conductive support having applied thereto a barrier layer consisting essentially of a doped hydrogen-containing amorphous silicon, next to said barrier layer an intermediate layer consisting essentially of hydrogen-containing amorphous silicon, next to said intermediate layer an intermediate barrier layer consisting essentially of doped hydrogen-containing amorphous silicon, and on a said intermediate barrier layer a main layer consisting essentially of hydrogen-containing amorphous silicon, said barrier layer and said intermediate barrier layer being of the same conductivity type, and said intermediate layer and said main layer each being entirely undoped when said barrier layer and intermediate barrier layer are of p-type conductivity and, when said barrier layer and said intermediate barrier layer are of n-type conductivity, being either entirely undoped or doped with up to about 30 pm of a dopant sufficient to cause said main and intermediate layers to be preferentially p-type conductive.

2. An electrophotographic element according to claim 1, said intermediate layer having a thickness of at least 3 μm.

3. An electrophotographic element according to claim 1, said main layer and said intermediate layer each consisting essentially of intrinsic amorphous silicon, said barrier layer and said intermediate barrier layer each consisting essentially of boron-doped p-type conductive amorphous silicon.

4. An electrophotographic element according to claim 1, said layers respectively being layers of the silicon produced by precipitation thereof from silane gas, and in the case of each doped layer by precipitation thereof from silane gas containing a small proportion of diborane or phosphine, under the influence of a glow-discharge plasma onto a said support being held at a temperature of between 150° and 200° C.

5. An electrophotographic element according to claim 1, 2, 3, or 4, comprising between said barrier layer and said main layer a plurality of said intermediate layers each having a said intermediate barrier layer applied onto it.

6. An electrophotographic element according to claim 1, 2, 3, or 4, comprising between said barrier layer and said main layer only one said intermediate layer and only one said intermediate barrier layer.

7. An electrophotographic element according to claim 6, said barrier layer and said intermediate barrier layer each having a thickness of about 0.1 to 0.3 μm, said intermediate layer having a thickness of at least 3 μm, and said main layer having a thickness of about 2 to 10 μm.

8. An electrophotographic element according to claim 1, said main layer and said intermediate layer each consisting essentially of hydrogen-containing amorphous silicon doped with up to about 30 ppm of a dopant sufficient to cause said layers to be preferentially p-type conductive, said barrier layer and said intermediate barrier layer each consisting essentially of phosphorous-doped, n-type conductive hydrogen-containing amorphous silicon.

* * * * *